United States Patent [19]

Strom et al.

[11] Patent Number: 5,020,292

[45] Date of Patent: Jun. 4, 1991

[54] DOOR CONSTRUCTION

[75] Inventors: Hans Strom; Jan Andersson, both of Astorp, Sweden

[73] Assignee: Svensk Dorrteknik AB, Sweden

[21] Appl. No.: 542,804

[22] Filed: Jun. 22, 1990

Related U.S. Application Data

[63] Continuation of Ser. No. 946,388, Dec. 23, 1986, abandoned, which is a continuation of Ser. No. 752,382, Jul. 3, 1985, abandoned.

[30] Foreign Application Priority Data

Jul. 4, 1984 [SE] Sweden ..... 8403541

[51] Int. Cl.[5] ..... E06B 5/20

[52] U.S. Cl. ..... 52/309.9; 52/309.11; 52/455; 428/151; 428/921

[58] Field of Search ..... 52/309.9, 309.11, 291, 52/455; 428/921, 151, 464

[56] References Cited

FOREIGN PATENT DOCUMENTS 144418 3/1954 Sweden .
339745 10/1971 Sweden .
80058688 2/1980 Sweden .

*Primary Examiner*—Richard E. Chilcot, Jr.
*Attorney, Agent, or Firm*—Lerner, David, Littenberg, Krumholz & Montlik

[57] ABSTRACT

Door constructions are provided including a frame, a core, and on both the inner and outer faces of the core an iron plate at least 0.2 millimeters thick with a wooden layer adhesively secured to the outer surfaces thereof. Preferably the core provided is a material having superior heat insulating properties with a heat conductivity of between about 0.15 and 0.05 as well as a diffusion resistance at least 20 times greater than that of air. In a preferred embodiment, each of the iron plates has a wooden layer adhesively secured to both the inner and outer surfaces thereof.

10 Claims, 1 Drawing Sheet

DOOR CONSTRUCTION

This is a continuation, of application Ser. No. 06/946,388 filed Dec. 23, 1986, which is a continuation of Ser. No. 752,382, filed July 3, 1985, both now abandoned.

FIELD OF THE INVENTION

The present invention relates to doors, and in particular to doors made of wood and wood-based materials. More particularly, the present invention relates to such doors intended for use either as exterior doors, doors between areas having different temperature and moisture environments, and doors between or leading to areas where fire breakthrough is to be avoided.

BACKGROUND OF THE INVENTION

A problem which has been encountered in the case of doors installed to be used as exterior doors, or between areas having different temperature and/or moisture environments, or where fire break-through is to be avoided, is the warping/deformation to which such doors are subjected due to its functioning as a barrier, or at least as a separating element between varying temperature and/or moisture conditions.

This problem has been investigated at length for a number of years, and has been dealt with, for example, in Swedish patent Nos. 144,418 and 339,745.

It has been established, for example, that the movement of moisture in a surface layer of wood is a factor which essentially affects the warping of a door. In an attempt to both obstruct the movement of moisture and to apply a barrier against diffusion, aluminum plates have been used on both sides of the door structure, thereby reducing both warping and the movement of moisture through the door.

If this were not done, the uncontrolled movement of moisture would lead to an increased divergence of the moisture ratio between the surface layers, and sometimes also within the door structure. In both cases, increased warping would result, and in some instances deteriorated heat insulation would also result.

The use of aluminum satisfies high demands with respect to both sheating and diffusion density. At the same time, one can also work this material with woodworking tools, and this is another decisive prerequisite in the manufacturing process.

On the other hand, one disadvantage of using aluminum is that it provides only a limited contribution to the fire-arresting qualities of the door, particularly since aluminum melts at the temperatures which can occur in such circumstances. Furthermore, the fact that one can apply commonly available tools and methods to the working of aluminum, while creating an advantage from a manufacturing point of view, does reduce the burglary protection thereof.

As the demands in terms of heat insulation increase, with the resultant use of more and more high-quality heat insulating materials, the relatively large thermal expansion of aluminum also creates problems. Improved insulation thus entails a greater difference in temperature between the surface layers, and this leads to increased warping of the door due to both temperature and moisture.

It is therefore an object of the present invention to eliminate these faults, and to introduce a door meeting high demands in terms of dimensional stability and heat insulation, as well as fire resistance and burglary protection.

SUMMARY OF THE INVENTION

In accordance with the present invention a door construction is provided which is at least externally identifiable as a wooden door, and which is capable of counteracting both warping and fire break-through. It has thus been discovered that these objects can be met by providing a door construction which includes an iron plate having a thickness of at least about 0.2 millimeters and a wooden layer adhesively secured or attached to the outer surface of such an iron plate on both sides of the door. The term a "wooden layer" is intended to include the many forms of such wooden layers used in door constructions, including wood veneer, massive wood, fiber board (medium density) and possibly also particle board.

By utilizing hot pressing, i.e., gluing at a raised temperature, either in the prefabrication of surface layers consisting of iron plate and wood or wood-based layers, or in the gluing of the door itself, a prestressed construction is achieved. This prestressing results in diminished movements due to variations in temperature and/or moisture.

A particularly favorable door construction hereof is obtained by attaching layers of wood or wood-based material on both the inner and outer surfaces of the iron plate on both faces of the door.

Even if for some reason prestressing should not be applied the placement of at least one layer of wood or wood-based material inside the iron plate provides an added favorable effect as regards dimensional stability in the face of both moisture and temperature variations.

As is mentioned above, moisture variations in the surface layers result in the door being subjected to the movement of moisture, and thus to warping. The layer which is located inside the plate, on the other hand, is not exposed to these variations, and thus resists such tendencies of moisture movement and/or warping. This favorable effect reaches its most noticeable level when the core material of the door has a diffusional density which is greater than about 20 times that of air, since in that case there can essentially be no movement of moisture within the door.

Similarly, in the case of extreme temperatures, for instance in connection with fire, this protected, inner wooden layer acts as a stabilizing factor. A freed iron plate, which would result from the outer wooden layers having been destroyed by fire, causes considerable warping of the door, with great concomitant risks of fire breakthrough in the slits. The use of an inner wooden layer counteracts this warping in a conclusive manner.

As for the nature of the iron plate used in this invention, it does not need to actually comprise "pure" iron but is more particularly meant to include the various brands of iron plates used on a commercial basis, such as steel, e.g., comprising aluminum and zinc. A preferred such iron plate is an "aluzinc" plate sold commercially by SSAB, and the quality of such steel is designated as B 500A.

Since iron plates have a lower temperature expansion coefficient than plates made of aluminum, one can thus allow considerable differences in temperature between the outside and the inside of the door without risking any strong temperature movements in the surface layers. Keeping this in mind, a further development of the present invention relates to the use of a core material for the door comprising a superior heat-insulating material having a thermal conductivity of between approximately $0.015<\lambda<0.050$ (W/m/C.°).

Such materials can be compare to the massive wooden cores according to Swedish patent No. 144,418 and to the porous laminated wood fiber (Swedish Patent No. 339,745), where $\lambda$ is 0.14 and 0.10, respectively.

In switching from porous laminated wood fiber (as per Swedish patent No. 339,745) to improved insulation, for instance where $\lambda=0.025$, one finds by both calculations and tests, that at differences in temperature of about 40° C. between the surface layers of the door, there is an increase in the temperature warping of aluminum of more than 2 millimeters as compared to the case of laminated wood fibers.

By utilizing the preferred adhesive attachment of iron plates on both sides of the frame of the door constructions of this invention and with a core of improved insulation as set forth above, surprisingly enough, the resultant warping becomes very slight in the possible environmental conditions of moisture and temperature which can be encountered.

The term "adhesive attachment" can have different meanings. Depending on the type of adhesive and method of application used, both a "rigid" glue line and a "gliding" joint may occur. From a reinforcement point of view, the first-mentioned alternative seems to be most appropriate.

Many of the present-day insulation materials, for instance polystyrene, PVC or polyurethane foam, can be hot pressed at temperatures of up to around +60° to +80° C. A particularly favorable effect is achieved by hot pressing at elevated temperature of between about +80° to +120° C. In such cases, so-called phenol foam can be used advantageously.

This latter foam also has advantages from a fire-risk point of view. Whereas other foams melt, burn and/or give rise to large amounts of toxic gases and smoke, phenol foam is stable at high temperatures and, when burning not only leaves a stable coal skeleton, but also produces very limited amounts of smoke.

A door consisting of wood and wood-based material and including the combination iron plate/phenol foam can therefore fulfill all of the requirements of a fireproof door, irrespective of whether it is tested according to ISO or ASTM methods, with all the existing differences.

The processing of iron in combination with wood has in the past been generally regarded as presenting an insoluble problem. However, it has now proven possible to perform this work in a fully satisfactory manner if, for instance, one divides the format cutting into several different operations, and applies a blade with a cutting depth which does not exceed about 20 millimeters, and which is preferably less than about 14 millimeters, when cutting the surface layers.

BRIEF DESCRIPTION OF THE DRAWINGS

The present invention can be more fully understood with reference to the attached figures, in which.

DESCRIPTION OF PREFERRED EMBODIMENTS

Figure 1:
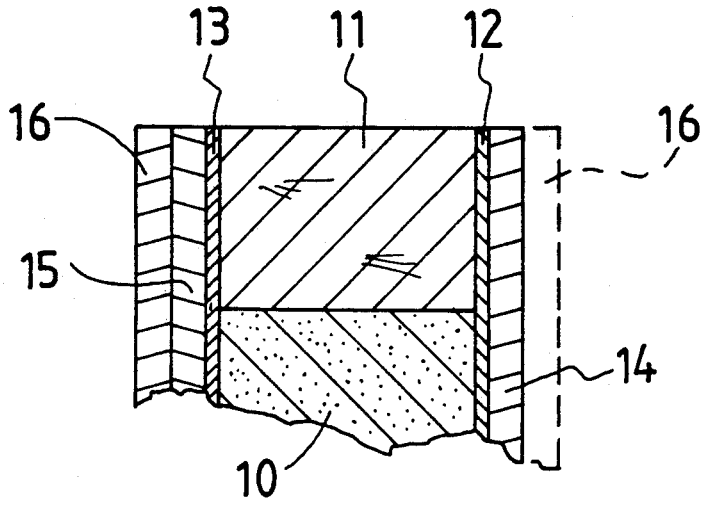
FIG. 1 is a partial, side, elevational, sectional view of a first embodiment of a door construction according to the present invention.

Referring to the figures, in which like numerals refer to like elements thereof, FIG. 1 shows a core 10 of foam plastics (constructional cellular plastic), in the preferred embodiment shown here, phenol foam plastic with closed cells, and which is placed in a wooden frame 11. Iron plates 12 and 13 are glued on one side to wooden layers 14 and 15. In this example, the iron plates have a thickness of 0.3 millimeters, while each wooden layer comprises a 1.5 millimeter thick layer of veneer.

Each laminated construction, comprising an iron plate and veneer layer, is preferably hot pressed in advance, and then glued to the frame. The hot pressing is carried out at a temperature of between about +80° and +120° C. However, the gluing together of the various elements in these laminated constructions can also be made simultaneously with their attachment to the frame 11.

The top veneer/wood-like facing 16 is glued to one or both sides of the door. This facing layer can also include layers which have the appearence of wood, including such plastic layers, since they are not attached directly to the iron plates.

Figure 2:
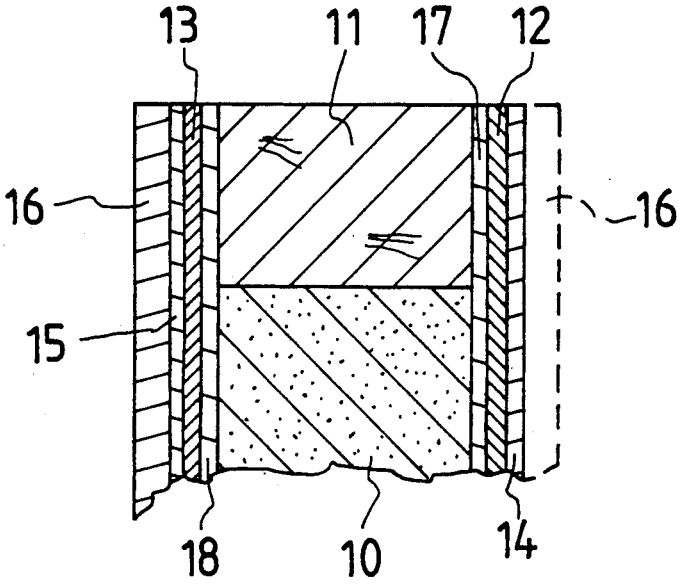
FIG. 2 is a partial, side elevational sectional view of another embodiment of a door construction of the present invention in which wood layers are arranged on both sides of respective iron plates.

Referring next to FIG. 2, there is shown therein iron plates 12 and 13 attached on both sides to wood layers 14 and 17, and 15 and 18, respectively. Each laminated construction 12, 14 and 17, and 13, 15 and 18, respectively, preferably has rigid glue lines achieved by means of hot pressing. When the core 10 consists of heat-resistant phenol plastic, the gluing is preferably effected at a temperature of between about +80° and +120° C. The facing 16 of wood veneer, massive wood or other wood-based or other such material is attached to either one or both sides of the door.

Figure 3:
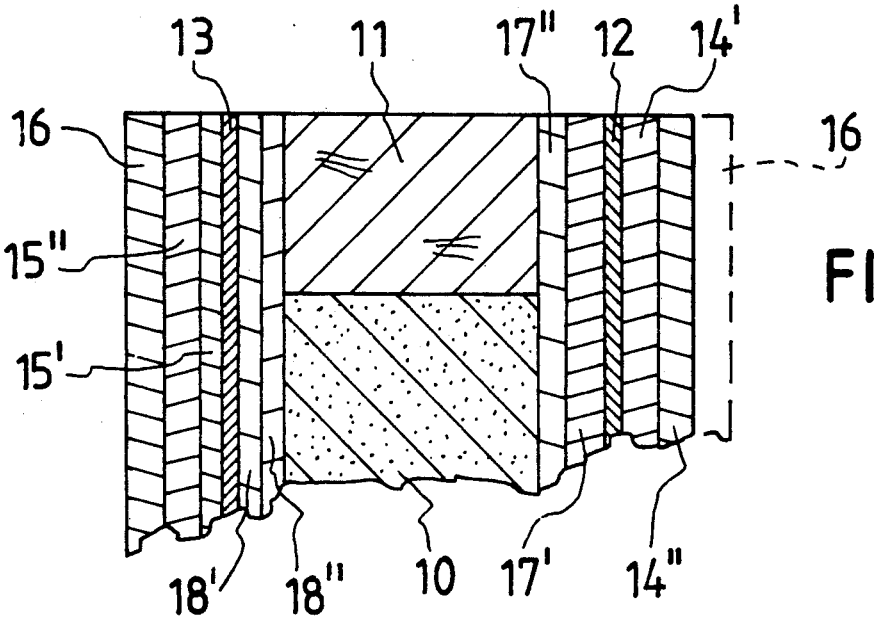
FIG. 3 is a partial, side elevational, sectional view of another embodiment of a door construction of the present invention having double layers of wood on each side of respective iron plates.

Referring next to FIG. 3, there is shown therein an embodiment where each laminated structure comprises an iron plate, 12 and 13, an internal double layer of wood 17', 17'' and 18', and 18'', respectively, and an external double layer, also of wood-based material, 14', 14'' and 15', 15'', respectively. These last-mentioned double layers have a suitable sheating 16.

The processing of the glued construction is divided into several separate operations. The surface layers, including the iron plate with layers on one or both sides thereof, are cut with a blade having a depth of cut not exceeding about 20 millimeters, and preferably less than about 14 millimeters.

This invention thus provides for a number of choices as regards the selection of materials and the arrangement of these layers. In the alternative presently providing optimal results, the material in the core of the door can, for instance, generally be defined as consisting of a material having excellent heat-insulating properties with a heat conductivity of $0.015<\lambda<0.050$, and having a diffusion resistance at least 20 times greater than that of air.

The veneer layers 14 and 15, as well as other wooden layers, can include or consist also of materials other than veneer, as well as being doubled or manifold, as desired.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What we claim is:

1. A door construction comprising a wood frame having opposing sides, a core provided within said frame, said core including a heat insulating material having a heat conductivity between about 0.015 and 0.050 (W/m/C.°), the door construction further including first and second outer faces overlying opposite sides of said frame, each said outer face including a first wooden layer, a second wooden layer, and an iron plate having a thickness in the range of about 0.2 to 0.5 millimeters disposed between the wooden layers and adhesively secured thereto, each said outer face being substantially prestressed, whereby said door construction is externally identifiable as a wooden door and is capable of counteracting warping and fire breakthrough.

2. The door construction of claim 1, wherein said core comprises a phenol foam material.

3. The door construction of claim 1, wherein said core comprises a material having a diffusion resistance which is at least 20 times greater than the diffusion resistance of air.

4. The door construction of claim 1, further including a joint adhesively securing said first wooden layer, in each said outer face the an outer surface of said iron plate in such outer face.

5. The door construction of claim 4, wherein each said joint is produced by hot pressing at a temperature of greater than about 80° C.

6. The door construction of claim 1, wherein said iron plate comprises steel.

7. The door construction of claim 1, wherein said first wooden layer is selected from the group consisting of wood veneer, high density wood, medium density fiberboard and particle board.

8. The door construction of claim 1, including a facing layer adhesively secured to the outer surface of at least one of said first wooden layers on said first and second outer faces.

9. The door construction of claim 8, wherein said facing layer comprises a layer having the appearance of wood.

10. The door construction of claim 9, wherein said facing layer comprises a plastic layer.

* * * * *

UNITED STATES PATENT AND TRADEMARK OFFICE

CERTIFICATE OF CORRECTION

PATENT NO. : 5,020,292

DATED : June 4, 1991

INVENTOR(S) : Strom et al.

It is certified that error appears in the above-identified patent and that said Letters Patent is hereby corrected as shown below:

Column 6, line 5, "the an" should read --to the--.

Signed and Sealed this

Twenty-second Day of December, 1992

*Attest:*

DOUGLAS B. COMER

*Attesting Officer*

*Acting Commissioner of Patents and Trademarks*